US005129519A

United States Patent [19]

David et al.

[11] Patent Number: 5,129,519

[45] Date of Patent: Jul. 14, 1992

[54] PACKAGING CONTAINER

[75] Inventors: John R. David; Joseph F. Garvey, both of St. Paul, Minn.; Curtis L. Larson, Hudson, Wis.; James M. Peck, St. Paul, Minn.; Norbert E. Wrobel, Marine-on-the-St. Croix, Minn.

[73] Assignee: Minnesota Mining and Manufacturing Company, St. Paul, Minn.

[21] Appl. No.: 403,132

[22] Filed: Sep. 5, 1989

[51] Int. Cl.[5] ..... B65D 81/02

[52] U.S. Cl. ..... 206/523; 206/592; 206/524.8

[58] Field of Search ..... 206/524.8, 522, 523, 206/592

[56] References Cited

U.S. PATENT DOCUMENTS

| | | | |
|---|---|---|---|
| 2,714,557 | 8/1955 | Mahaffy | 206/524.8 |
| 2,958,593 | 11/1960 | Hoover | 51/295 |
| 2,985,287 | 12/1960 | Schulz | 206/46 |
| 3,028,981 | 4/1962 | Ford et al. | 214/10.5 |
| 3,238,599 | 3/1966 | Bauman | 29/91.1 |
| 3,307,318 | 2/1964 | Bauman | 52/743 |
| 3,412,521 | 11/1968 | Bauman | 53/36 |
| 3,419,134 | 12/1968 | Fitts | 206/47 |
| 3,420,363 | 1/1969 | Blickensderfer | 206/46 |
| 3,503,177 | 3/1970 | Kropscott et al. | 53/35 |
| 3,537,121 | 11/1970 | McAvoy | 15/230.12 |
| 3,546,828 | 12/1970 | Lundberg et al. | 53/24 |
| 3,686,782 | 8/1972 | Erickson et al. | 206/520 |
| 3,968,620 | 7/1976 | Keltner | 53/24 |
| 4,116,336 | 9/1978 | Sorensen et al. | 206/524.8 |
| 4,154,344 | 5/1979 | Yenni, Jr. et al. | 206/524.6 |
| 4,156,751 | 5/1979 | Yenni, Jr. et al. | 428/212 |
| 4,190,158 | 2/1980 | Ambrose | 206/522 |
| 4,193,499 | 3/1980 | Lookholder | 206/524 |
| 4,240,556 | 12/1980 | Field | 206/522 |
| 4,551,379 | 11/1985 | Kerr | 428/200 |
| 4,620,633 | 11/1986 | Lookholder | 206/523 |
| 4,640,080 | 2/1987 | Wright | 53/449 |
| 4,669,632 | 6/1987 | Kawasaki et al. | 220/423 |
| 4,683,702 | 8/1987 | Vis | 206/524.8 |
| 4,781,296 | 11/1988 | Morris et al. | 206/610 |

FOREIGN PATENT DOCUMENTS

| | | | |
|---|---|---|---|
| 0192417 | 8/1986 | European Pat. Off. . | |
| 0137843 | 5/1988 | European Pat. Off. . | |
| 0306740 | 3/1989 | European Pat. Off. . | |
| 0325070 | 7/1989 | European Pat. Off. . | |
| 0306207 | 8/1989 | European Pat. Off. . | |
| 1394877 | 5/1975 | United Kingdom | 206/522 |

*Primary Examiner*—Joseph Man-Fu Moy
*Attorney, Agent, or Firm*—Kinney & Lange

[57] ABSTRACT

A protective packaging container for encasing an article therein has air impermeable inner and outer walls. The inner wall defines a pouch for reception of the article, and the inner and outer walls are bonded together to define a hermetic chamber therebetween. Within the chamber, a mass of resilient compressible material is disposed, assuming a first compressed state when a reduced atmospheric pressure is maintained in the chamber. The resilient material assumes a second expanded state when the material is exposed to atmospheric pressure, when the chamber hermetic seal is breached. Upon expansion, the resilient material urges the inner wall about the article and provides an impact-absorbing cushion about the article. In one embodiment, a relatively inflexible protective panel member is provided on each side of the packaging container within the chamber between the resilient compressible material and the outer wall. Thus, expansion of the resilient material urges each protective panel outwardly against the outer wall to provide an impact resistant shield about the article.

46 Claims, 12 Drawing Sheets

PACKAGING CONTAINER

BACKGROUND OF THE INVENTION

1. Field of the Invention

This invention relates to packaging devices, and in particular, to impact-resistent and impact-absorbing packaging devices for protecting an article contained therein.

2. Description of the Prior Art

The shipment and storage of articles which require special handling (e.g., fragile articles) has long plagued the packaging industry. Loose fill, such as shredded newspapers or foam beads (i.e., "peanuts"), have been tried as a means to protect article in a container, but such loose fill still allows shifting of the article in the container, and does not provide an affirmative cradling or nesting for the article in the container. Another attempt to solve this problem is to use premolded, form-fitting foam or other impact absorbing shells which are designed to encapsulate the article within some other container. Of course, the problem with this approach is that the shells must be preformed and designed specifically for the article to be stored or shipped.

One other approach to this problem has been the development of expandable or inflatable cushions mounted within a container. The article to be protected is placed between one or more of such cushions and the cushion expanded to envelope the article. In its expanded state, the material is impact absorbing and thereby shields the article from direct impact forces acting on the container, such as if the container were dropped. Such cushions have taken the form of simple inflatable air bladders, or expandable foam.

Examples of impact absorbing packaging devices using such an expandable foam material are shown in Lookholder U.S. Pat. No. 4,193,499 and Lookholder U.S. Pat. No. 4,620,633, both of which are incorporated by reference herein. In the Lookholder '499 patent, the article is placed in an envelope-like container which is, at least in part, surrounded by expandable material. The expandable material is a mixture of polystyrene beads and a blowing agent sealed within an air-tight pouch. To expand this polystyrene bead mixture and make it impact-absorbing, the mixture is exposed to microwave radiation. In the Lookholder '633 patent, the container is essentially the same, but the expandable material is a slab of compressed open-celled cellular material such as synthetic foam. The material is hermetically sealed in a pouch in its initial compressed state, and the pouch is held in a reduced atmospheric pressure condition to maintain the cellular material in its compressed state (no air within its open cells). To expand the material, the pouch is breached to raise its pressure to that of atmospheric pressure, which allows air into the interstices of the open-celled cellular material, thereby expanding the material to provide a cushion for the article retained in the envelope between expanded layers of the foam material.

The compressed foam approach of the Lookholder '633 patent is quite useful and simple in creating an easy to use, relatively efficient impact-absorbing packaging container for a article that requires special handling. While this packaging container does provide some protection for an article placed therein, it is still desired to provide a packaging container which has the ability not only to absorb impact forces, but also to resist them and spread them out across the surface of the package, so as to better protect the article therein.

SUMMARY OF THE INVENTION

The present invention is directed to a wall structure for a packaging container designed to encase an article, and which has at least one open end for reception of the article therein. The wall structure includes an air-impermeable inner wall which is conformable for engaging the article, and an air-impermeable outer wall spaced from the inner wall and bonded thereto to define a hermetic chamber therebetween. A relatively inflexible, impact-resistant protective panel member is provided adjacent the outer wall, and a mass of resilient compressible material is provided within the chamber. The resilient material has a first compressed state when a reduced atmospheric pressure is maintained in the chamber, and a second expanded state when the material is exposed to atmospheric pressure. In its expanded state, the resilient material urges the inner wall about the article and provides an impact absorbing cushion about the article.

In one preferred embodiment, the outer and inner walls are flexible, with the outer wall defining an envelope shape for the packaging container which has two major opposed sides. The inner wall defines a pouch for reception of the article and a protective panel member is positioned within the chamber on each major side of the envelope between the resilient material and the outer wall so that upon the resilient material assuming its expanded state, the protective panel member is urged outwardly against the outer wall to provide an impact-resistant shield about the article.

In another preferred embodiment, the wall structure includes an air-impermeable inner wall which is conformable for engaging the article and an air-impermeable outer wall spaced from the inner wall and bonded thereto to define a hermetic chamber therebetween. A mass of resilient compressible material is provided within the chamber, and has a first compressed state when reduced atmospheric pressure is maintained in the chamber and a second expanded state when the material is exposed to atmospheric pressure. The resilient material in its expanded state urges the inner wall about the article and provides an impact-absorbing cushion about the article. A wall of conductive material encases the article and provides an electromagnetic radiation shield therefore. Alternatively, a layer of static-dissipation material encases the article to protect the article from static electricity discharges.

In a further embodiment of the present invention, a packaging container for encasing an article includes an air-impermeable inner wall which defines an article chamber that is conformable for engaging the article and has an open end for reception of the article therein. An air-impermeable outer envelope wall is spaced from the inner wall and bonded thereto to define a hermetic chamber therebetween. The outer envelope wall has an opening therein aligned with the open end of the chamber, and the opening of the outer envelope wall is smaller than the open end of the article chamber. A mass of resilient compressible material is positioned within the hermetic chamber between the outer envelope wall and the inner wall, and has an open portion aligned with the open end of the article chamber and opening of the outer envelope wall. The resilient material has a first compressed state under reduced atmospheric pressure in the hermetic chamber and has a second expanded state when exposed to atmospheric pressure whereby, upon expansion, the resilient material provides an impact-absorbing cushion about the article in the article chamber.

BRIEF DESCRIPTION OF THE DRAWINGS

The invention will be further described with reference to the accompanying drawings where like numbers refer to like parts in several views and wherein.

Figure 1:
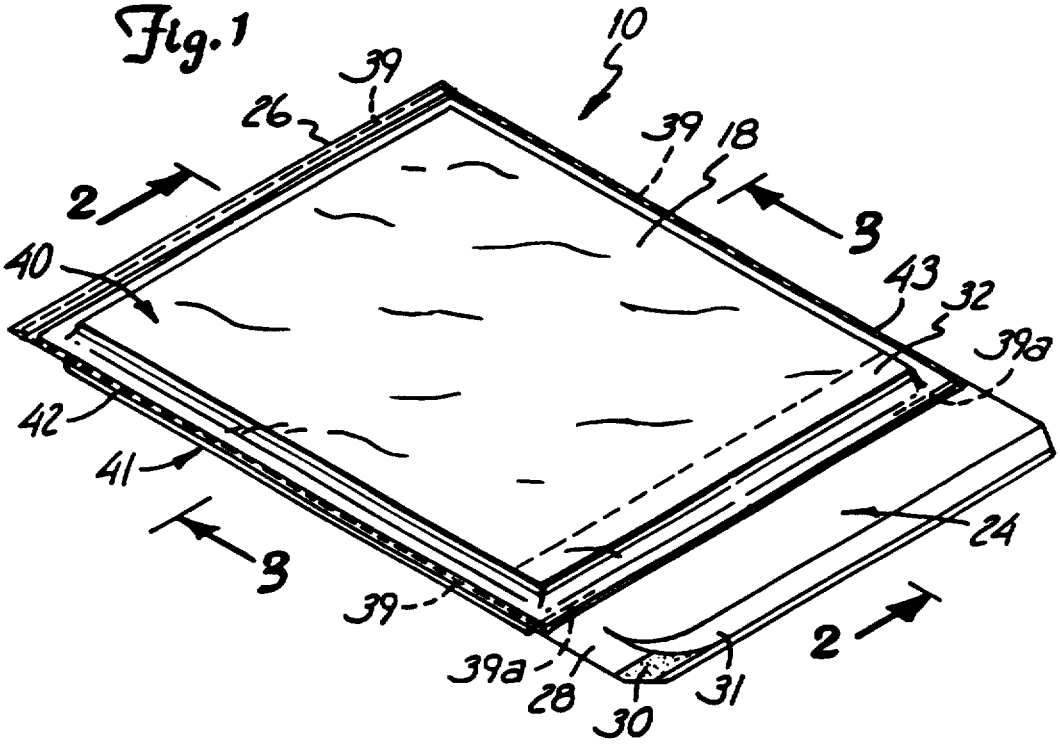
FIG. 1 is a perspective view of a packaging container according to the present invention, prior to expansion of the resilient compressible layers therein.

It is understood that the drawing figures herein are provided for illustrative purposes only and are not drawn to scale, nor should they be construed to limit the intended scope and purpose of the present invention.

DETAILED DESCRIPTION OF THE PREFERRED EMBODIMENTS

FIGS. 1–6 show one preferred embodiment of the packaging container of the present invention. In this embodiment, a packaging container 10 takes the shape of a conventional shipping envelope. The container 10 is adapted to store or ship an article 11 which may be fragile or otherwise require protection during handling (e.g., glass articles, electronic components or circuit boards, jewelry, medical tissue or fluid samples, etc.). In order to protect the article 11, the container 10 has a novel wall structure which includes an inner flexible wall 12, a resilient layer of compressible material 14, a relatively inflexible layer or panel 16 and an outer flexible wall 18 (see FIGS. 2 and 3).

The outer wall 18 is air-impermeable and, as seen, is formed to define the conventional envelope shape for the packaging container 10, having an open end 24 and a closed end 26. At its open end 24, a flap portion 28 of the outer wall 18 extends beyond the open end 24 and is of size sufficient to fold over and close the open end 24 of the envelope. Preferably, an inner surface of flap 28 is coated with a pressure sensitive adhesive 30 and a peel-away removable sheet 31 adhered over the pressure sensitive adhesive 30. The peel-away sheet 31 is thus pulled off of the pressure sensitive adhesive 30 and the flap 28 folded over the open end 24 to adhere it to an opposed end portion of the outer wall 18, as at end area 32 thereof.

Figure 2:
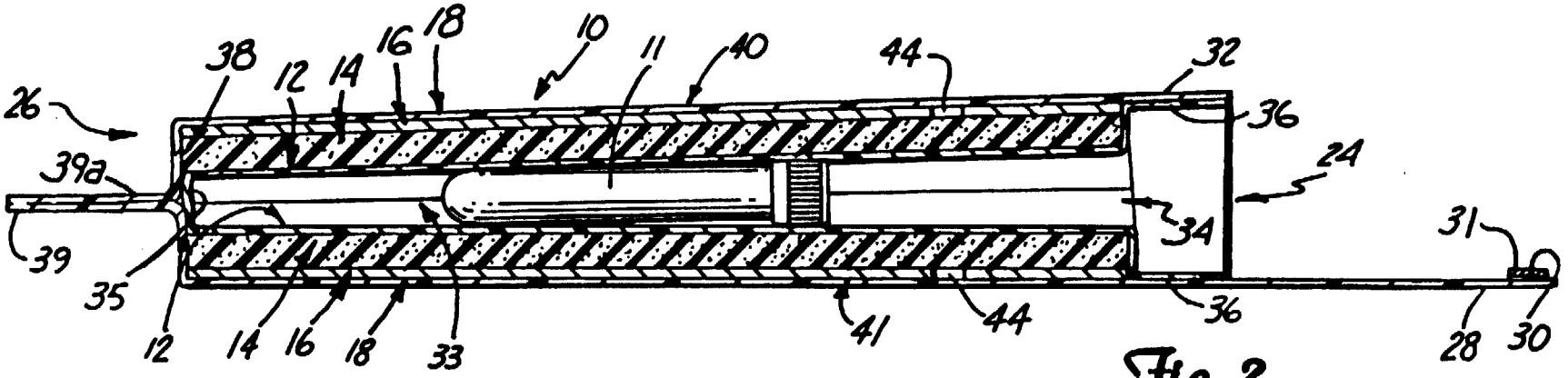
FIG. 2 is a sectional view as taken along lines 2—2 in FIG. 1.

The inner wall 12 is also air-impermeable and is adapted to form an article-enclosing pouch 33 within the packaging container 10, as seen in FIGS. 1 and 2. The pouch 33, defined by the inner wall 12, has an open end 34 aligned with the open end 24 of the envelope for reception of the article 11 therein, and an opposite closed end 35. Preferably, the article-contacting surface of the inner wall 12 is sufficiently smooth to facilitate slidable insertion of the article 11 into the pouch 33, yet sufficiently rough to retard undesired slipping and sliding of the article 11 within the pouch 33. At the open end 34, the ends of the inner wall 12 are bonded to an inner surface of outer wall 18 (as at bond areas 36) to define a chamber 38 between the outer wall 18 and the inner wall 12. Preferably, the outer wall 18 and inner wall 12 are formed from or each include a layer of heat-sealable material, so that the bond 34 may be achieved as a heat-sealed bond to create an air-tight chamber 38. In a preferred embodiment, the outer wall 18 (envelope) and the inner wall 12 (article pouch) are formed from high density polyethylene material with a barrier film thereon to make the material air-impermeable.

Figure 3:
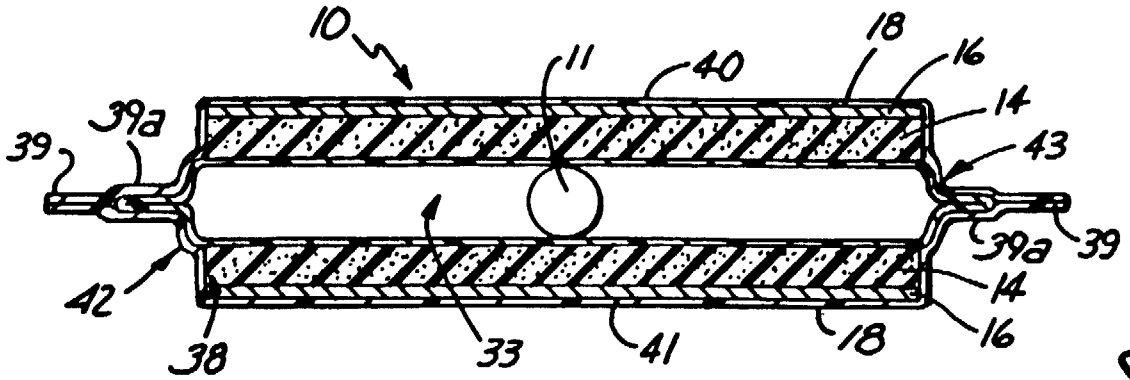
FIG. 3 is a section view as taken along lines 3—3 in FIG. 2.

Of course, alternative methods for bonding the walls together are also contemplated, so long as the bond acts to create a hermetically-sealed chamber between the inner wall 12 and outer wall 18. Typically, the envelope formed by the outer wall 18 is defined from two outer walls sheets which are bonded together adjacent their peripheries, except at open end 24. In FIGS. 1-3, this peripheral bonding is indicated generally as at 39. The pouch 33 defined by the inner wall 12 may also be formed in this matter. In addition, the inner and outer walls may be bonded together about the side and end peripheries of the walls (thereby encasing each resilient layer of compressible material in its own separate chamber) as at 39*a* in FIGS. 2 and 3.

As illustrated in FIG. 2, the sealed chamber 38 is generally U-shaped in longitudinal cross-section and, as illustrated in FIG. 3, the chamber is generally rectangularly-shaped in lateral cross-section. The envelope, as is usual, has two major or long sides 40 and 41, and two minor or short sides 42 and 43. A resilient layer of compressible material 14 is disposed within the chamber 38 and along each of the major sides 40 and 41 of the envelope. Each resilient layer of material is preferably a layer of polyurethane open-celled cellular foam. Such open-celled cellular material may also be natural sponge, sponge rubber, polyester, polyethylene or cellulose foam. Alternatively, the resilient layer of compressible material may be formed from a non-woven fibrous material having a low density (high void volume), such as the material sold under the trademark "Scotchbrite" by Minnesota Mining and Manufacturing Company of St. Paul, Minn., and those materials disclosed in U.S. Pat. No. 3,537,121 and 2,958,593, both of which are incorporated by reference herein. Each resilient layer of compressible material, in a preferred embodiment, is a slab or compressed block of such open-celled material, but can also consist of unbonded pieces of compressible open-celled cellular material.

Figure 4:
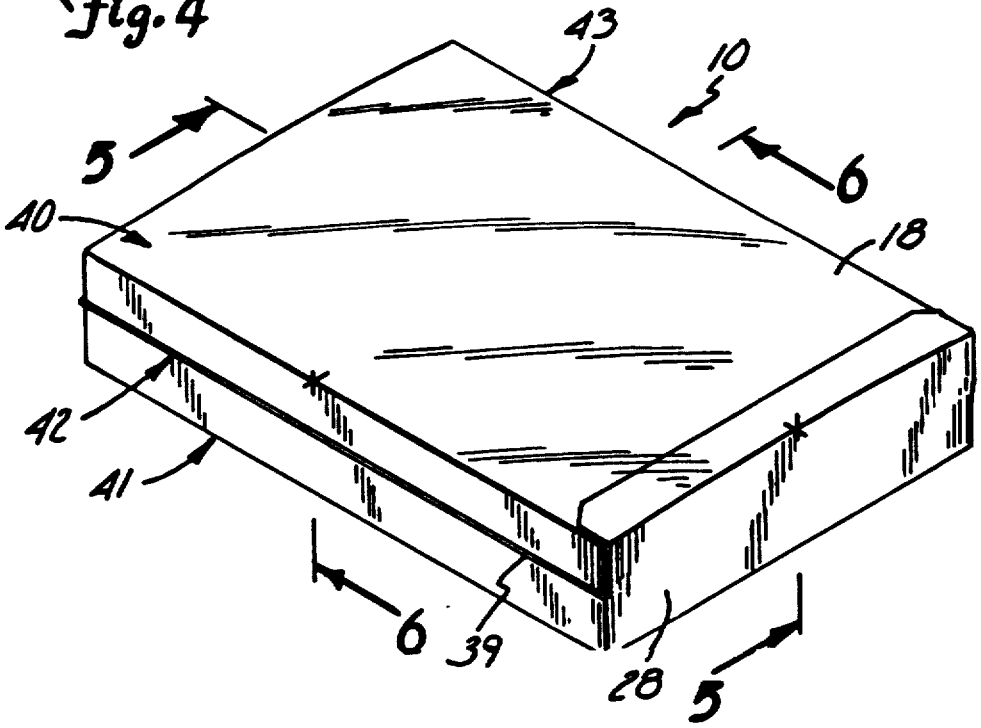
FIG. 4 is a perspective view of the packaging container of FIG. after expansion of the resilient compressible layers therein and sealing of the envelope flap thereof.
Figure 5:
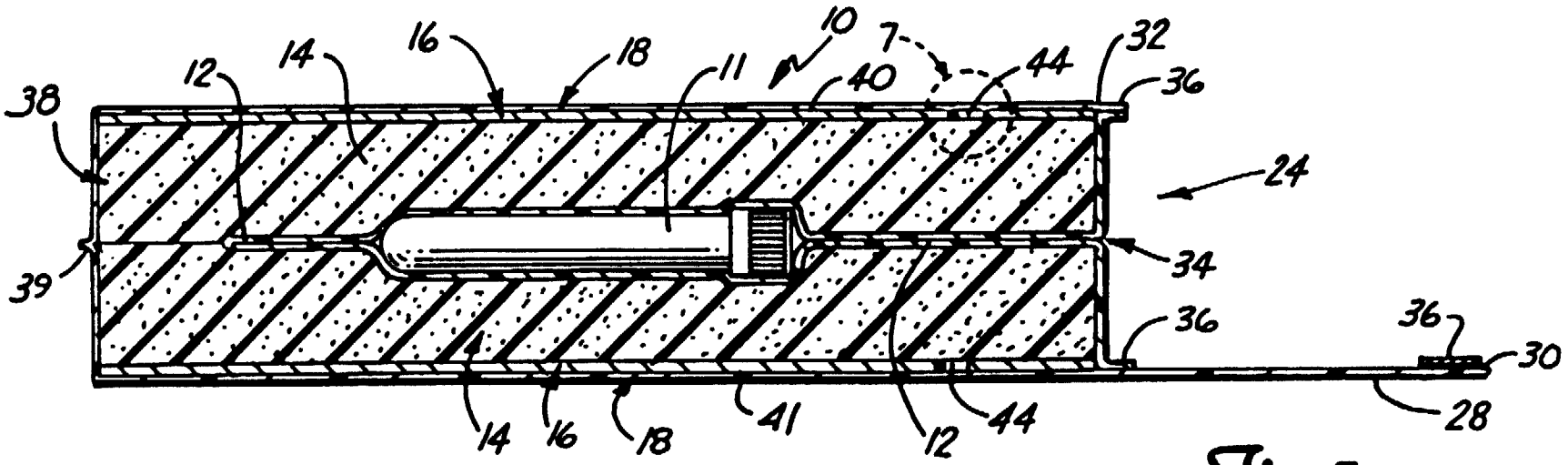
FIG. 5 is a sectional view as taken along lines 5—5 in FIG. 4.
Figure 6:
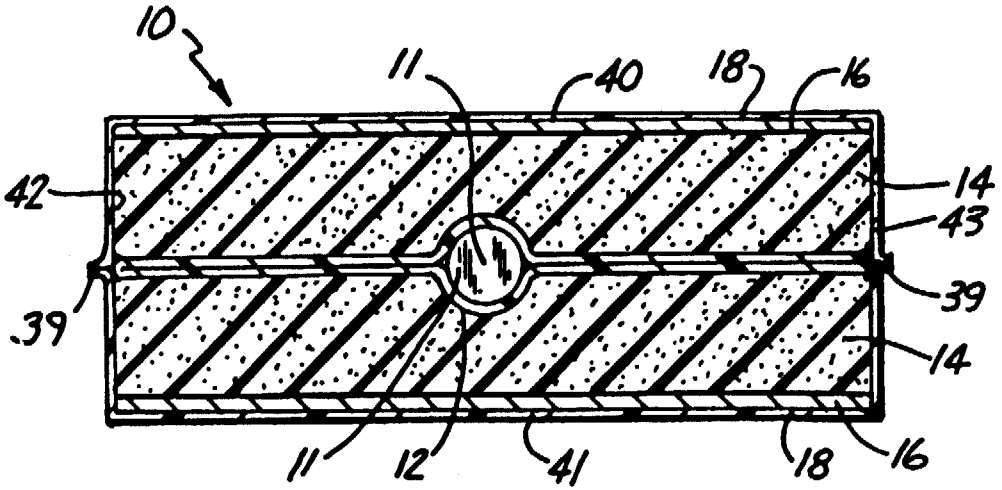
FIG. 6 is a sectional view as taken along lines 6—6 in FIG. 4.

In connection with the packaging container of the present invention, each resilient layer of compressible material 14 has two states: a first compressed state (as illustrated in FIGS. 1-3) and a second expanded state (as illustrated in FIGS. 4-6). Initially, the layer of compressible material 14 is maintained under a reduced atmospheric pressure or vacuum within the air-tight chamber 38, which acts to flatten the layer of compressible material 14 to a thin layer and to retain it in this flattened or compressed state. The layer of material 14, in its compressed state, thus has a relatively thin profile or depth, as indicated in FIGS. 2 and 3. Because the flexible inner wall 12 and outer wall 18 are used to define the vacuum chamber 38 for the layer of material 14, those walls cling tightly to the compressed and air-evacuated layer of compressible material 14.

In this first preferred embodiment, a relatively inflexible and generally planar panel 16 is also provided on each major side of the envelope, between the layer of compressible material 14 and the outer wall 18. The panel 16 provides rigidity to the envelope in use, and acts as an impact-resistant protective surface for the contents of the packaging container 10. The panel 16 is rigid enough to resist impact and compressive forces on the packaging container 10 by distributing those forces across the face of the panel 16. In a preferred embodiment, the panel 16 is formed from chipboard, but can also be formed from any suitable stiffener material such as corrugated paperboard, paper stock, a stiff plastic sheet or a composite of these materials.

In use, an article 11 is placed within the pouch 33 as illustrated in FIGS. 2 and 3. To create an impact-absorbing cushion about the article 11, the air-tight seal between the ambient atmosphere and the chamber 38 is broken by puncturing the otherwise air-impermeable outer wall 18 with a suitable object, such as a pencil or ball-point pen tip. The layer of compressible material 14, having a resilient "memory" of its expanded shape and no longer restrained by the reduced atmospheric pressure in the chamber 38, expands to occupy the space between the inner wall 12 and outer wall 18. This is accomplished by air filling the open cellular structure of the layer of compressible material 14 so that it assumes its second expanded state. Preferably, the layer of compressible material 14 is, in its compressed state, reduced to approximately twenty percent of its original thickness. Upon exposure to atmospheric pressure, the layer of compressible material 14 then expands to eighty percent of its original thickness within one minute. Thus, the desired transition by the layer of material from its compressed state to an operable expanded state occurs relatively rapidly, in a matter of seconds.

The packaging container 10 of the present invention is designed to accommodate the desired expansion of the layer of compressible material 14. The outer wall 18 is flexible and yields to the expanding material, as does the inner wall 12, which is urged about the article 11 as the material expands (see FIGS. 5 and 6). In addition, the chamber 38 is defined with sufficient dimensions so that it is substantially if not entirely filled by the layer of compressible material 14 upon expansion, as further illustrated in FIGS. 5 and 6. Preferably, the outer wall 18 is of a size such that those portions of the opposed layers of compressible material along the sides 41, 43 and end 26 of the envelope are urged relatively tightly together upon expansion. This significantly limits the possibility that the article 11 will slip around in the pouch 33 (between material layers), and especially acts to prevent the article 11 from shifting out of the central portion of the container 10 toward one of the sides or ends thereof where it would be less protected from possible damage during handling of the container 10.

As can also be seen in FIGS. 4-6, after expansion of layer of compressible material 14 the panel 16 (with the outer wall 18 stretched relatively tightly over the panel on each of the major sides 40 and 41 of the envelope) defines a generally planar outer wall surface for the packaging container 10 which resists and distributes impact forces. This planar surface also makes the packaging container 10 easier to handle, stack and pack for storage or shipment.

To facilitate puncture of the sealed chamber 38 and resultant expansion of the compressed material, one or more apertures 44 are provided through each panel 16.

Figure 7:
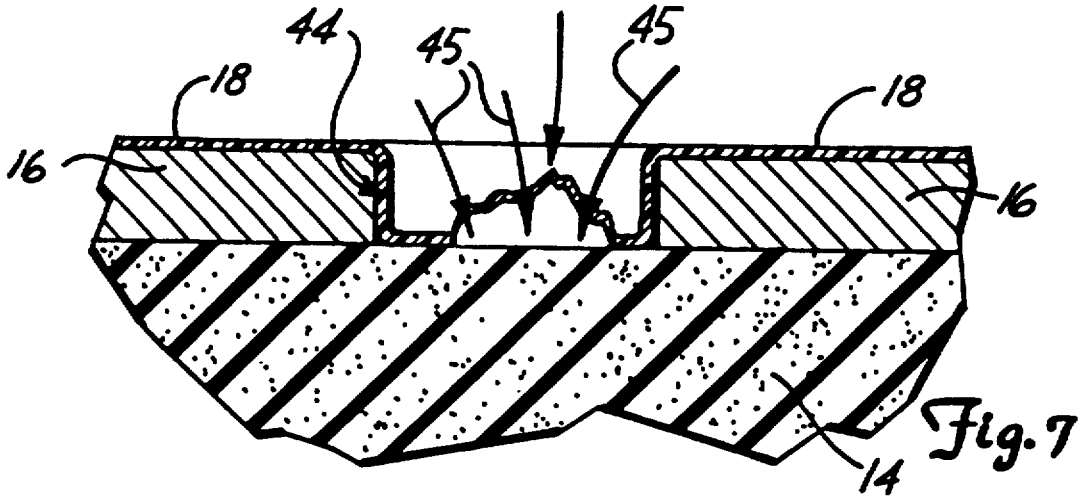
FIG. 7 is an enlarged detail section view as taken on area 7 in FIG. 5.

Such apertures 44 act as a gasket for air flow through an adjacent puncture hole (such as a hole, slit, vent or any suitable opening) in the outer wall 18 by spacing the loose pieces of wall material adjacent the hole from the layer of compressible material (see FIG. 7, where air flow into the chamber 38 through aperture 44 is indicated by arrows 45). Alternatively, the outer wall 18 and adjacent panel 16 are simply punctured at any point to initiate expansion. In order to use this latter puncturing technique, however, the panel 16 must be formed from a puncturable material, such as corrugated paperboard or cardstock. Of course, it is also possible to puncture the chamber 38 along the sides 41, 43 or ends 24, 26 where there is no protective panel.

The inner wall 12 and layer of compressible material 14 conform, upon expansion of the material 14, to surround the article 11 in all directions, as seen in FIGS. 5 and 6. The article 11 is thus fully cradled or suspended by the expanded layer of compressible material 14 within the packaging container 10. For use, the packaging container 10 can then be sealed, via flap 28, to complete the process of enclosing the article 11 therein. As is apparent from FIG. 4, the expanded packaging container 10 has a box-like outward appearance, as opposed to resembling an envelope.

While the above discussion and identified drawing figures describe one preferred embodiment, other embodiments of the present invention are also contemplated. The additional figures and discussion herein describes further embodiments of the present invention. Where the feature is relatively unchanged, the same reference numerals are used for identification purposes and clarity. In all cases, the disclosure herein presents illustrated embodiments of the present invention by way of representation and not limitation. It should be understood that numerous other modifications and embodiments can be devised by those skilled in the art which will fall within the scope and spirit of the principles of this invention. For example, although the packaging container 10 is illustrated with a panel 16 on each of its major sides, a panel may be necessary on only one major side of the packaging container 10, depending upon the intended application for the container 10.

Figure 8:
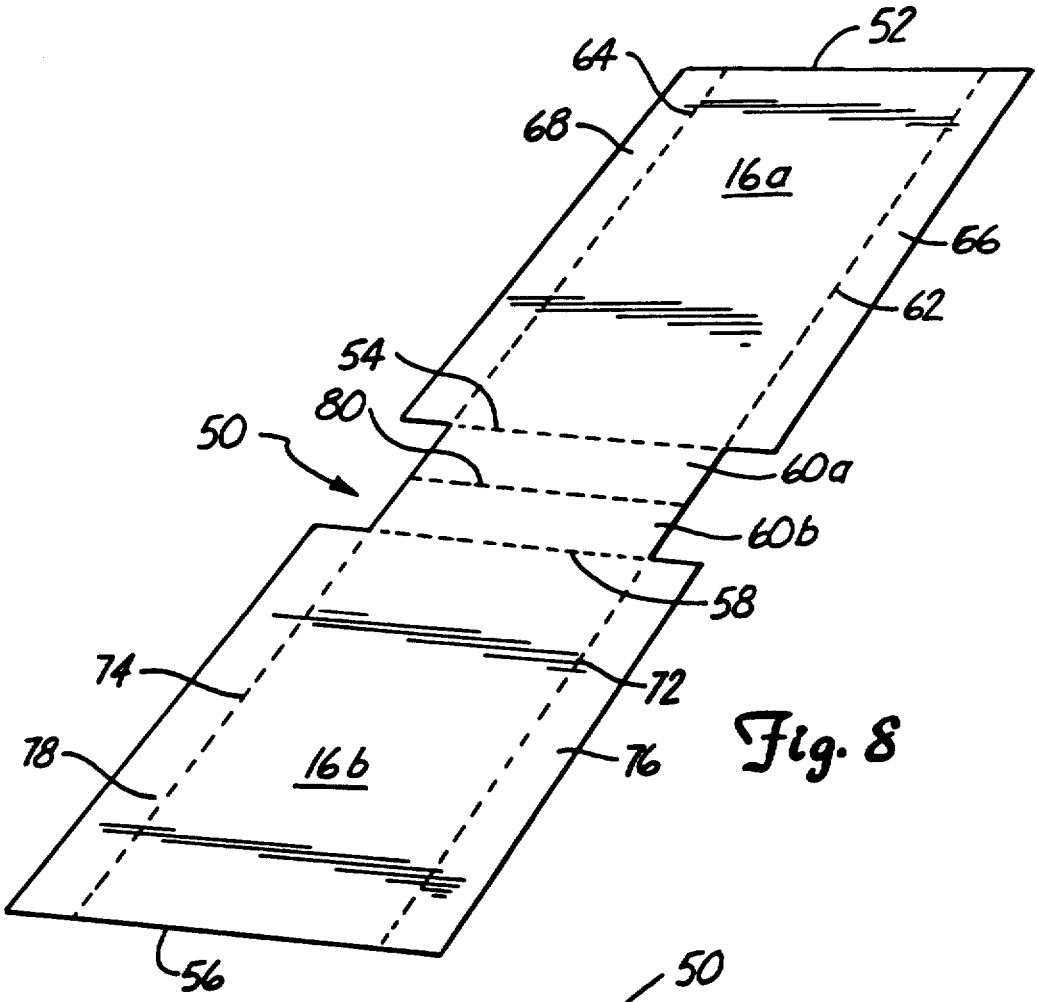
FIG. 8 is a perspective view of a panel blank for use in an alternative embodiment of the packaging container of the present invention.

Alternatively, when two panels are employed, they can be connected or formed from a single panel blank. FIG. 8 illustrates such a panel blank 50, which has a first major panel **16*a* and a second major panel 16*b*. Panel 16*a* has an open-end edge 52 and an opposed closed-end edge 54, while panel 16*b* has an open-end edge 56 and an opposed closed-end edge 58. The panel 16*a* and 16*b* are connected together at their closed-end edges 54 and 58, respectively, by one or more connected end panels 60*a*, 60*b***.

Panel **16*a* has side edges 62 and 64. Attached to these side edges 62 and 64 are side panels 66 and 68, respectively. Similarly, panel 16*b* has side edges 72 and 74, with side panels 76 and 78 connected to the panel 16*b* therealong. The dashed lines in FIG. 8, indicating the side end edges of the panel 16*a* and 16*b* are preferably score lines, with the panel 16*a* and 16*b*, end panels 60*a* and 60*b* and side panels 66, 68, 76 and 78 all hingedly connected together along the score lines and formed from one unitary blank of planar material. An additional score line 80 is provided between the end panel 60*a* and 60*b***.

Figure 9:
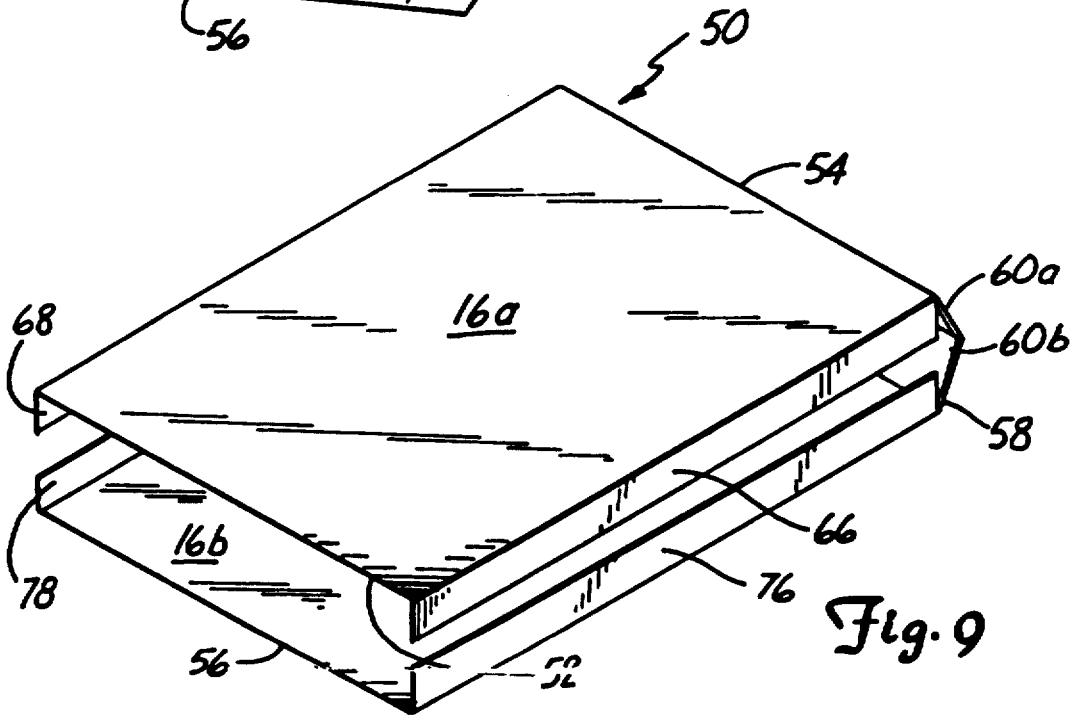
FIG. 9 is a perspective view of the panel blank of FIG. 8 in a folded configuration.

For use in combination with the packaging container of the present invention (referenced in FIGS. 10–14 as packaging container **10*a*) the blank 50 is folded along its score lines to the form generally shown in FIG. 9. The side panels and end panels thus provide additional protection for the article which is encased by the packaging container 10*a* when the compressible material 14** therein is expanded.

Figure 10:
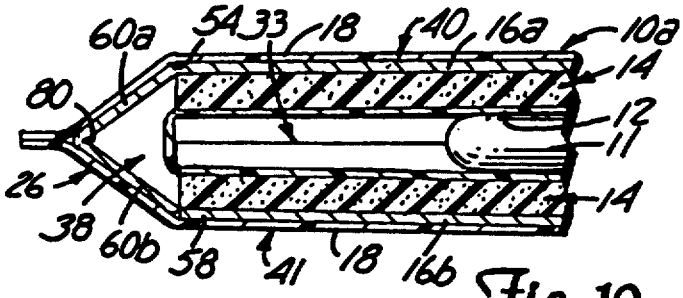
FIG. 10 is a partial longitudinal sectional view of an alternative embodiment of the packaging container of the present invention employing the panel blank of FIGS. 8 and 9, with the resilient compressible layers therein unexpanded.
Figure 11:
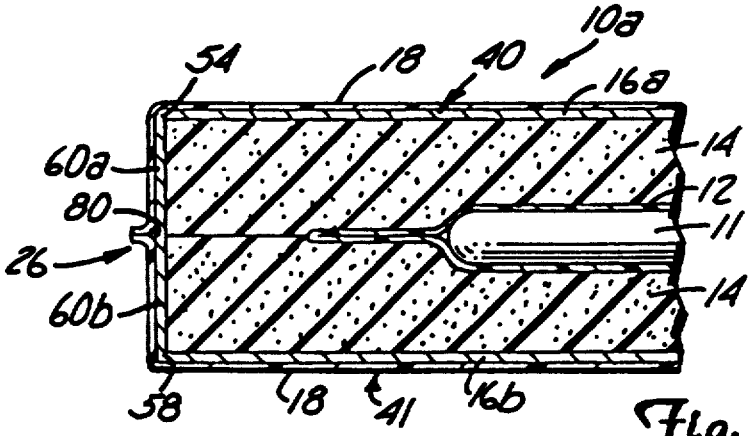
FIG. 11 is a partial longitudinal sectional view similar to that of FIG. 10, with the resilient compressible layers of the packaging container expanded.

FIGS. 10–13 illustrate the relative configurations of the end and side panels before and after expansion of the compressible material 14. In FIG. 10, the closed end of the packaging container **10*a* is illustrated with the layers of compressible material 14 in their unexpanded states, with the end panels 60*a* and 60*b* folded at fold line 80 at a relatively acute angle. Upon expansion, however, the end panels 60*a* and 60*b* are aligned generally coplanar along a plane generally perpendicular to the panels 16*a* and 16*b*, at end edges (fold lines) 54 and 58**.

Figure 12:
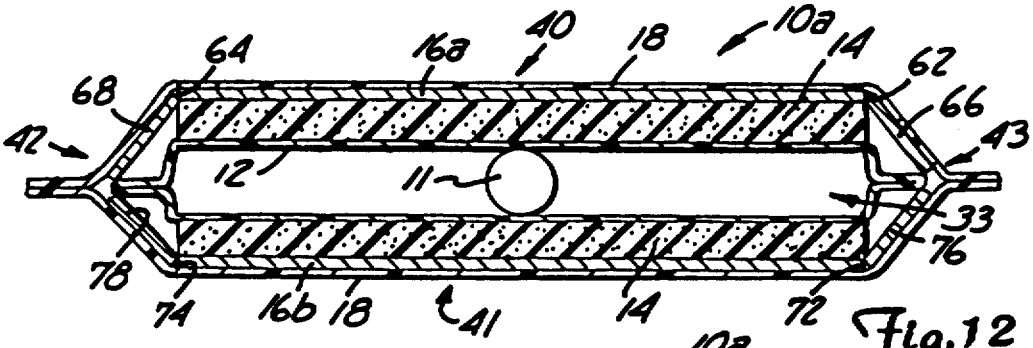
FIG. 12 is a lateral sectional view of the packaging container of FIG. 10, the resilient compressible layers unexpanded.

The side panels react in a similar manner upon expansion of the compressible material 14. In FIG. 12, it is seen that the side panels 66, 68, 76 and 78 lie generally flattened across the lateral face of the packaging container **10*a* prior to expansion of the compressible material 14. After expansion, however, the side panels are aligned generally perpendicular to the panels 16*a* and 16*b*, as seen in FIG. 13 (additional longitudinal scoring of the side panels 16*a* and 16*b*** will result in a more gradual arcuate side for the container).

Figure 13:
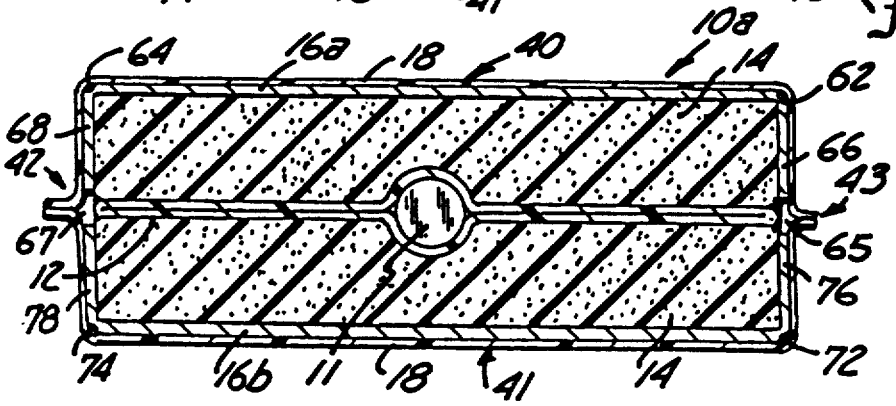
FIG. 13 is a view similar to that of FIG. 12, with the resilient compressible layers expanded.
Figure 14:
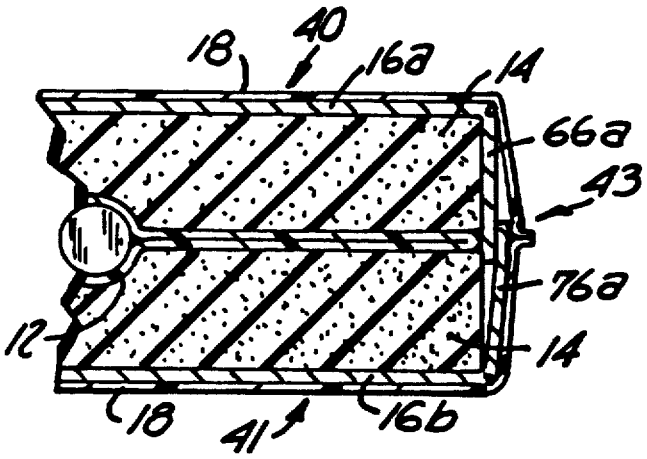
FIG. 14 is a partial lateral sectional view of an alternative embodiment of the panel blank with the resilient compressible layers expanded.

The side panels are dimensioned such that their outer edges are spaced apart upon expansion of the compressible material 14 (note gaps 65 and 67 in FIG. 13). This relationship is also illustrated in FIG. 9, where the blank 50 is shown as it would appear upon expansion, with the outer edges of the opposed side panels 66, 76 and 68, 78 spaced apart when the panels **16*a* and 16*b* are aligned generally parallel. This spacing allows some impact compression (up and down as viewed in FIG. 13) of the compressible material before the outer edges of the side panels can abut. Alternatively, the side panels can be dimensioned such that upon expansion of the compressible material 14, the outer portions of the side panels overlap and upon compression of the packaging container 10*a*, the side panels slide upon one another to permit impact-absorbing compression of the packaging container 10*a*. This overlapped configuration is illustrated by overlapped side panels 66*a* and 76*a* in FIG. 14**, for one side of the packaging container.

Preferably, the panel on the major side of the envelope-shaped container is of size to fully define the generally rectangular side of the container upon expansion. However, although discussed and illustrated as a generally rectangular panel, the panels 16 (or **16*a* and 16*b*) along the major sides 40 and 41 of the envelope need not be rectangular in shape. It may be desirable in some applications to use a panel of a different shape along the major faces of the envelope. For example, it may be desirable only to provide a perimeter edging panel extending around the peripheral edge of each major side of the envelope, while leaving the central area of the major side free of a reinforcing panel. While this arrangement might compromise the impact-resistant nature of the packaging container, it would provide an envelope-based container having a relatively box-like shape upon expansion of the compressible material 14 therein. Similarly, it is contemplated that a unitary panel blank such as blank 50 be used without the side panels 66, 68, 76 and 78. It is advantageous the panels 16*a* and 16*b* to be joined together, at least at one end, to prevent misalignment or skewing material 14** (which are also generally rectangular).

Figure 15A:
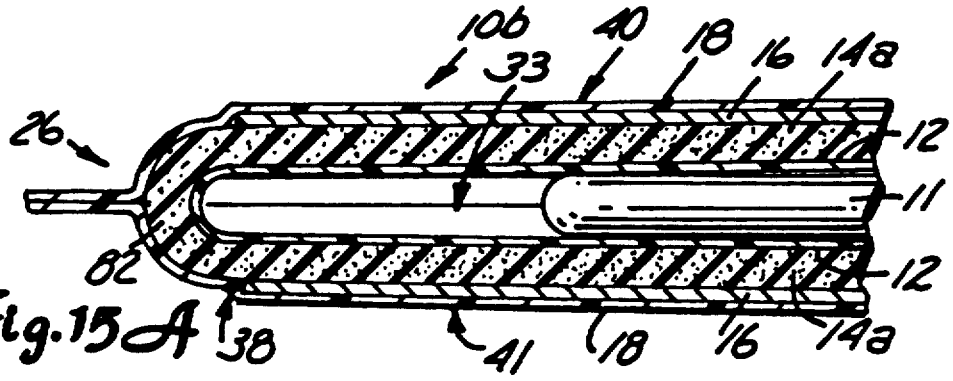
FIG. 15A is a partial longitudinal sectional view of a further embodiment of the packaging container of the present invention, with its resilient compressible layer unexpanded.
Figure 15B:
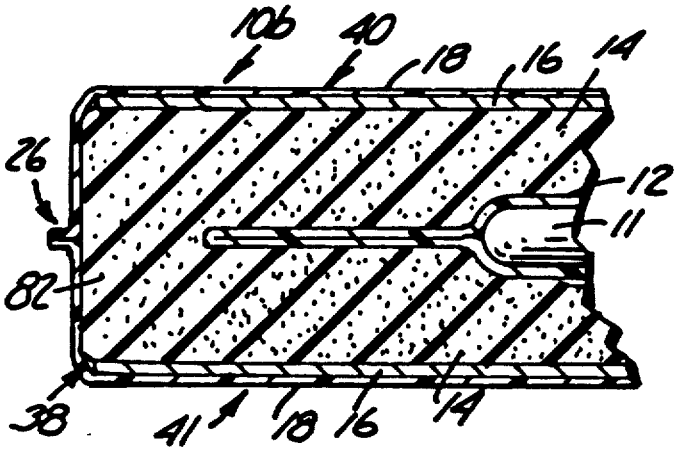
FIG. 15B is a partial longitudinal sectional view similar to that of 15A, with the resilient compressible layer in its expanded state.

Regardless of the configuration of the protective panels, other embodiments of the packaging container of the present invention may be modified from the embodiments illustrated in FIGS. 1-14 and discussed above. For example, the layers of compressible material 14 may take configurations other than simple opposed slabs of foam-like material or non-woven porous material. As illustrated in FIG. 15A, the compressible material 14 may be a continuous layer 14*a*, having a U-shaped end 82 at the closed end 26 of the envelope of packaging container 10*b*. This provides a more affirmative cushion end for the packaging container 10*b*, since there is no break or separation between opposed layers of compressible material at the closed end 26 between the inner wall 12 and outer wall 18, as seen in FIG. 15B.

Figure 16:
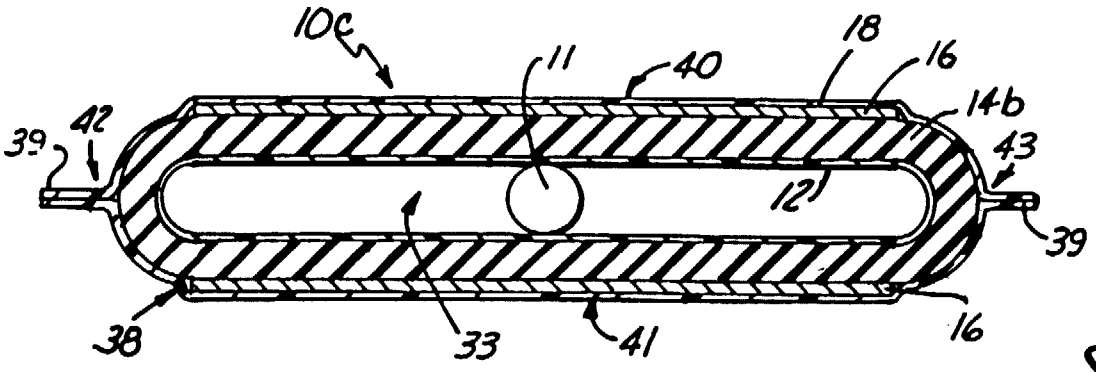
FIG. 16 is a lateral sectional view of a further embodiment of the packaging container of the present invention, with the resilient compressible layer therein in its unexpanded state.

In another preferred embodiment, the compressible material 14 positioned about the pouch 33 is formed from a tubular section 14*b* of material (as seen in FIG. 16) rather than two opposed slabs or layers 14 (as illustrated in FIG. 3). The use of a tubular arrangement provides an affirmative unbroken layer of expanded material along the sides 42 and 43 the envelope of a packaging container 10*c*, between the inner wall 12 and outer wall 18 thereof.

A further preferred embodiment would involve a combination of the structures illustrated in FIGS. 15 and 16. In other words, the mass of resilient compressible material surrounding the article would be a unitary structure having a chamber defined therein for reception of the pouch and article therein, with one end open for receiving the article and with the other end and sides integrally formed to be closed. Thus, upon expansion of the compressible material, the article would be encapsulated by a unitary mass of cushioning material on all sides except one (and on that side, the compressible material layers would expand together in the manner illustrated by FIG. 2 at the open end of the envelope).

Figure 17:
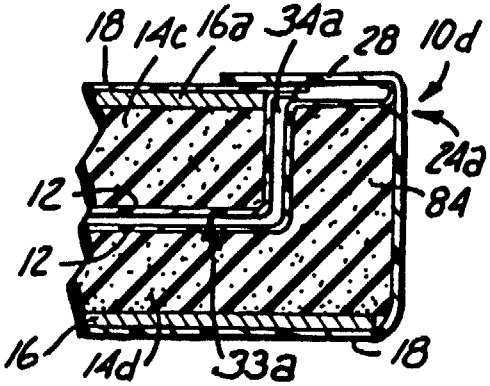
FIG. 17 is a partial longitudinal sectional view of a further embodiment of the packaging container of the present invention, with its resilient compressible layers in their expanded state.

A further modification to the shape of the compressible material 14 in the packaging container of the present invention is illustrated in FIG. 17. In this embodiment, a packaging container 10*d* has an envelope with an "open" end 24*a* which has an article chamber opening 34*a* defined between one end of a first layer of compressible material 14*c* and an upstanding portion 84 on a second layer of compressible material 14*d*. As seen in FIG. 17, a flap 28 of the outer wall 18 is again sealable to close the end 24*a* of the packaging container 10*d*. With an open end structure as illustrated in FIG. 17 (as primarily defined by the shape of the expanded and mating layers of compressible material 14*c* and 14*d*), an affirmative layer of expanded material is provided along the "open" end 24*a* of the packaging container 10*d*, between inner wall 12 and outer wall 18, to protect the article therein.

A further refinement to the shape of the opposed layers of compressible material 14 for the packaging container of the present invention is achieved by preforming the inner surfaces thereof (the surfaces defining the chamber for the article) to mirror the shape of the article being sheltered. For example, if the article being enclosed by the packaging container is a medical vial, the layers of compressible material 14 can be preformed to have a partial cavity therein accommodating the shape of such a vial when expanded. Alternatively, a generic article cavity can be provided, of size and shape suitable for various objects. The layer of compressible material may also be formed with a convoluted inner surface (like an egg carton), which upon expansion forms small air pockets between the opposed material layers and adjacent the article for further cushioning effect.

The size of the pouch relative to the outer container (envelope) may also be relevant to the degree of article protection in some applications. A looser or larger pouch may allow the inner surface of the expanded material layers to better conform to the surface of the article. This may be particular useful when the article has an uneven profile. Alternatively, an article with the relatively smooth profile (such as a box or tube) may be better served by a smaller pouch which would retain the article more centrally within the expanded layers of compressible material.

For certain types of articles, it is desirable to provide protection other than or in addition to impact-absorption and impact-resistance. For example, certain electronic components or assemblies must be protected from damaging electrostatic discharges during handling. Further, protection is sometimes necessary for articles which might be adversely affected by electromagnetic radiation such as photographic film, and more particularly, magnetic media such as magnetic tape or disks for recording purposes. Such components may also be relatively fragile and require handling with care, which can be accommodated by the expandable packaging container structure of the present invention.

Figure 18:
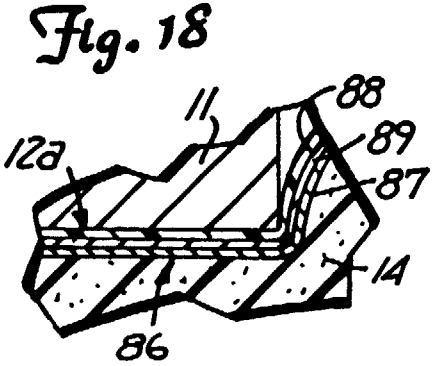
FIG. 18 is an enlarged detail sectional view of a multi-layer sheet employed in the packaging container of the present invention.

In one preferred embodiment of the present invention, the packaging container has a wall of conductive material encasing the article to provide an electromagnetic radiation shield therefor. Preferably, and as illustrated in FIG. 18, this wall of conductive material is defined by a sheet 86 having a highly conductive outer layer 87 for grounding electrostatic discharges brought into contact with the packaging container. As illustrated in FIG. 18, an inner wall 12*a* of the packaging container is defined by the sheet 86. For further protection for the article 11, a layer of static-dissipation material is provided in connection with the inner wall 12*a*. In this case, the sheet 86 has an inner anti-static layer 88 to protect the article 11 from static electricity discharge. Preferably, the sheet 86 is formed from a polymeric material having a high volume resistivity to electrically isolate a component encased by the sheet (inner wall 12*a*) by being essentially nonconductive. This nonconductive sheet preferably includes a nonconductive support layer 89 between its inner anti-static layer 88 and outer highly conductive layer 87. U.S. Pat. Nos. 4,154,344 and 4,156,751 (which are incorporated herein by reference) teach the specifics of the formation and characteristics of such a sheet. While FIG. 18 illustrates the sheet having both an inner anti-static layer and an outer highly conductive layer, the sheet can be provided with only one of those layers, depending upon the desired application. In addition, the sheet may constitute the outer wall of the packaging container instead of the inner wall, or may comprise an additional sheet about the article. Further, other protective sheets or layers may be provided adjacent the article or around the outer wall of the container.

Figure 19:
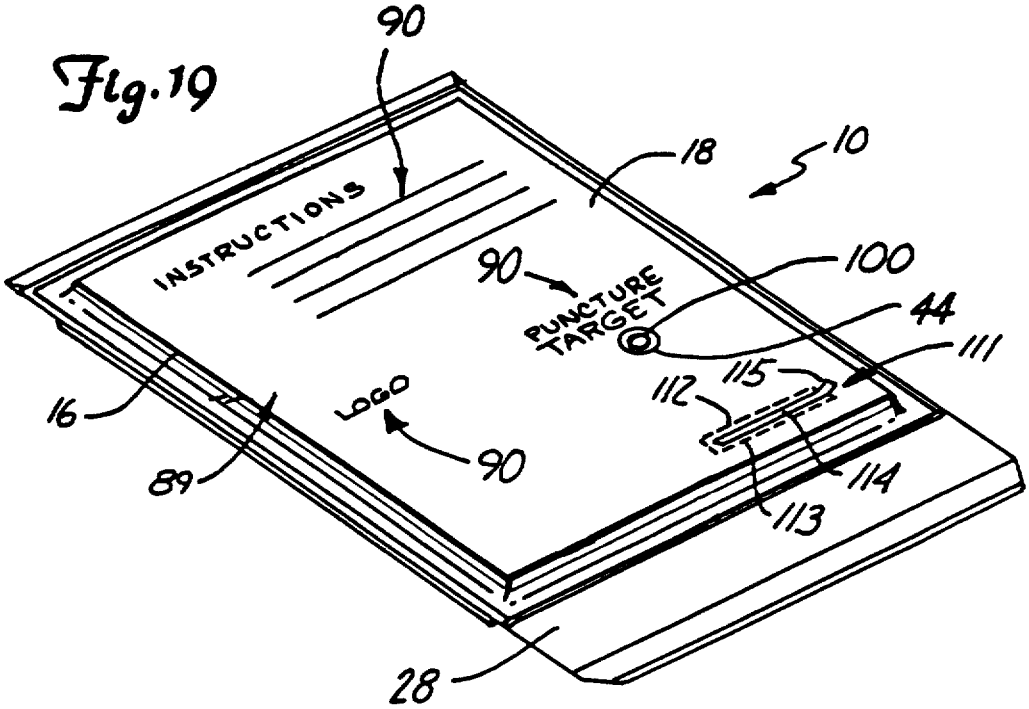
FIG. 19 is a perspective view of an alternative embodiment of the packaging container of the present invention, illustrating a see-through outer wall and visible indicia on a sheet or rigid panel thereunder.

In another preferred embodiment, the outer wall 18 is translucent or transparent. As illustrated in FIG. 19, a separate sheet 89 between the outer wall 18 and the panel 16 has identifying or instructional indicia 90 thereon which is visible through the outer wall 18 (or the panel 16 itself may bear such indicia). The indicia 90 on the panel 16 preferably includes a target area 100 for identifying the preferred point of puncture for the outer wall 18. This target area 100 thus directs an operator to pierce the outer wall 18 at a particular location thereon to facilitate breaching the reduced atmospheric pressure in the space between the outer wall 18 and inner wall 12 in the interior of the envelope, and thereby expand the compressible material 14. As seen in FIG. 19, the target area 100 is aligned with the aperture 44 through the panel 16 to further enhance the passage of air into the space between the chamber 38 for the layer of compressible material 14.

Figure 20:
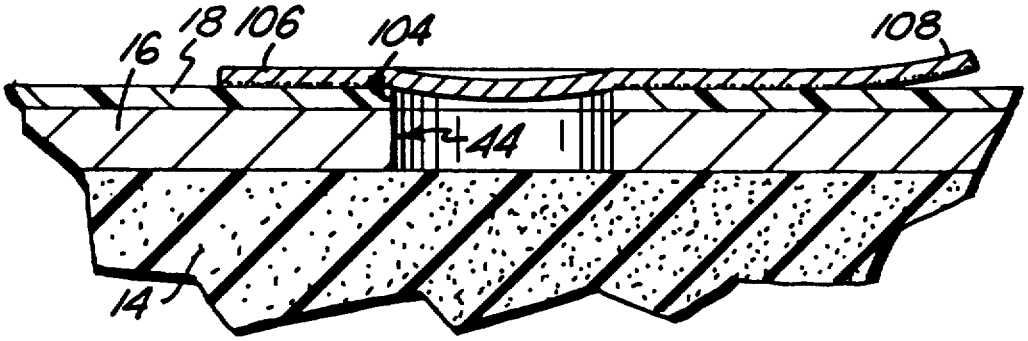
FIG. 20 is an enlarged detail sectional view showing a releasable aperture cover for use in controlling the expansion of the resilient compressible layers in the packaging container of the present invention.

Another preferred embodiment of the packaging container of the present invention provides preformed apertures in both the protective panel and the outer wall. As illustrated in FIG. 20, a pre-formed aperture 104 in the outer wall 18*a* is aligned with the aperture 44 in the panel 16. In order to cover the apertures 44 and 104, and thus create a hermetic seal for the compressed material 14, a removable cover 106 is provided over the aperture 104 on the outer wall 18*a*. The cover 106 is preferably sealed to the outer wall 18*a* about its aperture 104, and a tab portion 108 of the cover 106 is unsecured to facilitate grasping and pulling the cover 106 off of outer wall 18*a*. By using a pressure sensitive adhesive to affix the cover 106 to the outer wall 18*a*, the cover 106 may be removed and then replaced over the aperture 104, before the layer of compressible material 14 is fully expanded if desired. Thus, an operator is able to control the rate and extent of expansion of the compressible material 14, which may be advantageous in certain applications of use for the packaging container.

Another means for breaching the hermetic seal about the compressed material in the packaging container is by use of a tear strip 111. As illustrated in FIG. 19, a tear strip 111 is formed on the outer wall 18 of the packaging container 10. The tear strip 111 is defined be score lines 112 and 113 which are weakened lines along the outer wall 18. A strip of reinforcing tape or other suitable reinforcing material 114 is typically aligned between the score lines 112 and 113, and has at least one free end 115. In use, the free end 115 of the tape 114 is pulled away from the outer wall 18, thereby separating the outer wall 18 along the score lines 112 and 113. This allows air into the chamber housing the compressible material, thereby allowing that material to expand. Further information and details regarding tear strip configurations are set forth in U.S. Pat. No. 4,781,296, which is incorporated by reference herein.

Of course, the primary purpose for the packaging container is to protect whatever article is placed therein. It is important for effective protection of a fragile article that the packaging container be adapted, in certain circumstances, not to receive articles which are too large. One means for ensuring that an article placed in the packaging container 10 will not be too large to be effectively cushioned by the resilient material within the container is to restrict the size of the open-end 34 of the article pouch 33. As illustrated in FIG. 1, the bonding seam 39 which extends along the sides 41, 43 and end 26 for the outer wall 18 also extends partially inwardly from each side along the open-end 24. Bond or seam areas 39*a* are illustrated along each side edge of the open-end 24 and extend partially inwardly from their respective side edge to reduce the size of the available lateral opening into the pouch 33. These bonds areas 39*a* affix together side portions of the otherwise unbonded open-end edges of the opposed outer walls 18. This arrangement thus limits the size of the pouch opening 34, and thereby the size of an article 11 that can be placed in the pouch 33. Of course, this arrangement will work in all of the packaging container embodiments discussed above, whether or not rigid panels are a part of the packaging container's protective wall structure. The bond areas 39*a* also pinch the expanded layers of resilient compressible material together about the pouch opening 34*a*, thereby further preventing shifting of an article therein toward the pouch opening or that end of the packaging container 10.

Figure 21:
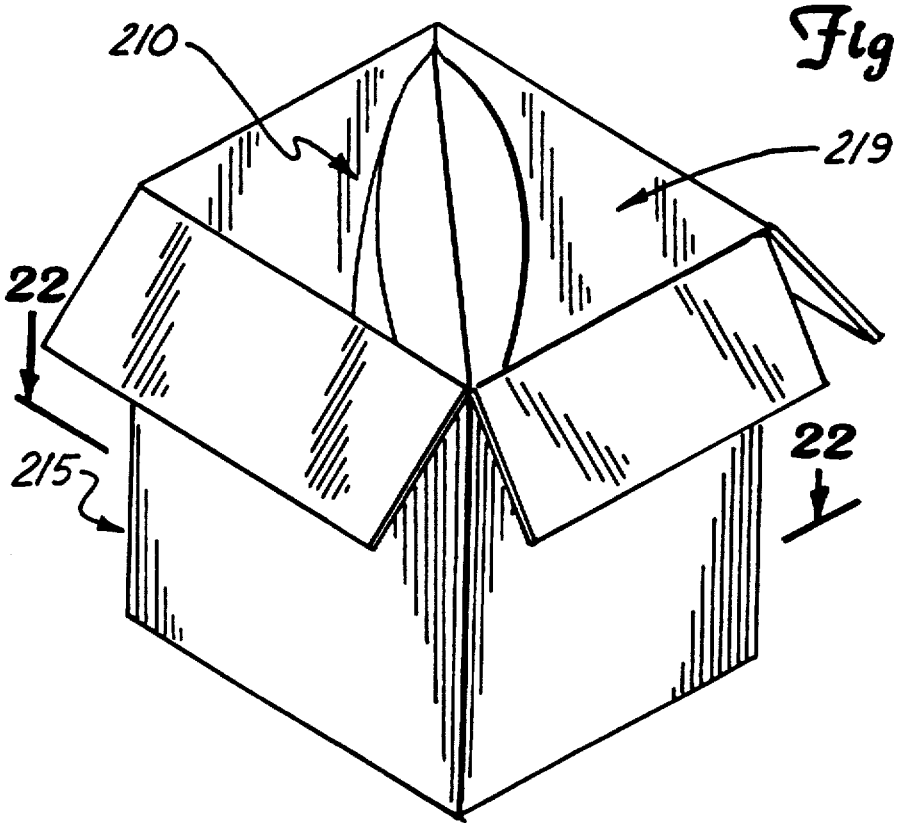
FIG. 21 is a perspective view of another alternative embodiment of the packaging container of the present invention.
Figure 22:
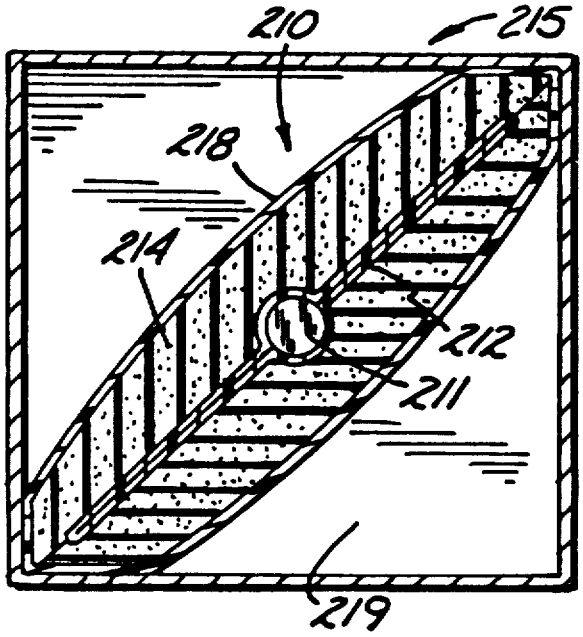
FIG. 22 is a sectional view as taken along lines 22—22 in FIG. 21.

A further packaging system embodying the packaging container of the present invention is illustrated in FIGS. 21 and 22. In this embodiment, an envelope-shaped packaging container 210 is retained snugly within a box-shaped, relatively rigid walled outer container 215. As seen in FIG. 22, the packaging container 210 is adapted to hold an article 211 therein (within a pouch defined by a flexible inner wall 212). A cushioning layer of expandable material 214 is retained about the inner wall 212 by a flexible outer wall 218. Although not shown in FIG. 22, rigid panels may also be provided within outer wall 218.

The inner wall 212 and outer wall 218 are air-impermeable and the material 214 is initially compressed, as discussed for the first embodiment of FIGS. 1–6. Upon puncture, the hermetic chamber defined between the inner wall 212 and outer wall 218 is breached and the material 214 expands to create an impact-absorption layer within the outer wall 218 and around the article 211. For shipping or to further prevent possible damage to the article 211, the outer box-shaped container 215 is provided to hold or "suspend" the packaging container 210 therein. The walls of the outer container 215 are relatively inflexible and impact-resistant.

The walls of the outer container 215 define an enclosure 219, which snugly supports the contours of the container 210 only along areas adjacent the side and end edges thereof. Upon expansion of the compressible material layers 214 in the container 210, the container 210 assumes a generally rectilinear-shape having a longitudinal length, a lateral side depth and a larger lateral side width. The enclosure 219 of the container 215 has a length approximately equal the longitudinal length of the container 210 and has a lateral diagonal approximately equal the larger lateral side width of the container 210. As seen in FIG. 22, the expanded material 214 along the side edges of container 210 compresses slightly to allow the container 210 to fit snugly within the enclosure 219 of the outer container 215, aligned along the lateral diagonal of the container 215 and extending from one inside corner of the enclosure 219 to another opposed inside corner thereof. For storage or shipment, the open end of the outer container 215 is then closed and sealed to firmly retain the container 210 therein.

FIGS. 23–27 illustrate another embodiment of the packaging container of the present invention. In this embodiment, the protective panels are positioned outside of the outer wall, rather than within the outer wall. The packaging container illustrated in FIGS. 23–27 has an inner envelope-shaped container 310, formed essentially the same as packaging container 10 of the embodiment illustrated in FIGS. 1–6, except that there are no rigid panels between the compressible material layers and the outer wall.

Figure 24:
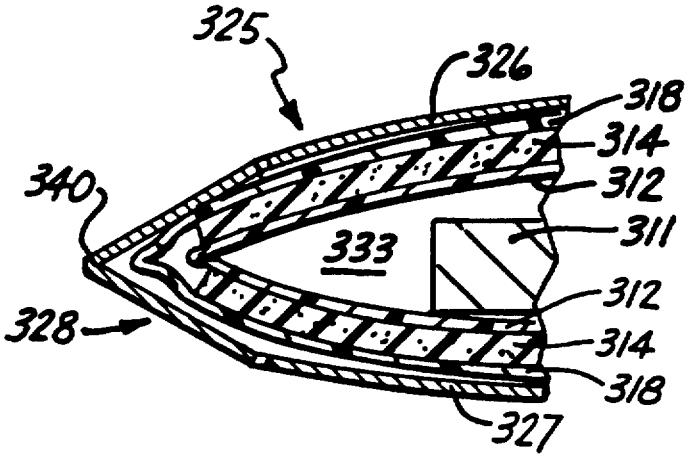
FIG. 24 is a partial sectional view as taken along lines 24—24 in FIG. 23.

As seen in FIG. 24, the inner envelope-shaped container 310 has an air-impermeable inner wall 312 which defines a pouch 333 for receiving an article 311. One or more resilient layers of compressed expandable material 314 are positioned between the inner wall 312 and an air-impermeable outer wall 318. The area between the inner wall 312 and outer wall 318 is subject to reduced atmospheric pressure or a vacuum to maintain the compressible material 314 in a flattened state, under compression.

Figure 23:
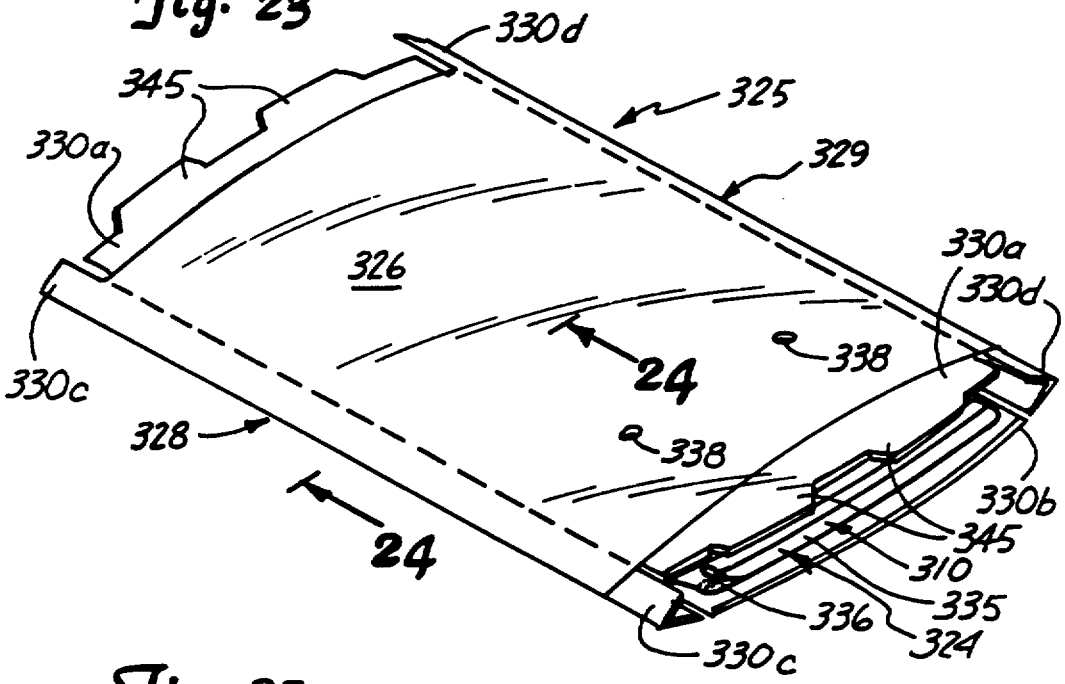
FIG. 23 is a perspective view of an alternative embodiment of the packaging container of the present invention, with the resilient compressible layers therein unexpanded.

An outer container structure 325 is provided about the envelope-shaped container 310 to provide an impact-resistant outer protective wall for safeguarding the article 311 therein. As illustrated in FIG. 23, the outer container structure 325 is defined by a plurality of relatively inflexible protective panels hingedly connected along hinge lines, including first and second major side panels 326, 327, and minor side panels 328, 329. At each end, the container 325 has a plurality of interlocking end panels 330*a*, 330*b*, 330*c* and 330*d* hingedly connected thereto.

Before expansion of the compressible material layers 314, the outer container 325 has a relatively flattened state, as illustrated in FIGS. 23 and 24. In this state, the major panels 326 and 327 are closely spaced, and the side panels 328 and 329 are each folded into two side panel sections along an intermediate longitudinal hinge or fold line 340, as illustrated in FIG. 24. In its flattened state, the ends of the outer container 325 are open and the interlocking end flaps 330A-330D extend outwardly, as seen in FIG. 23. The plurality of protective side panels and end panels forming the outer container 325 are preferably formed from a unitary panel blank. The blank, which is preferably formed from corrugated paperboard, is scored along the hinge connections between the various panels to define those connections and to define the panels themselves.

Figure 25:
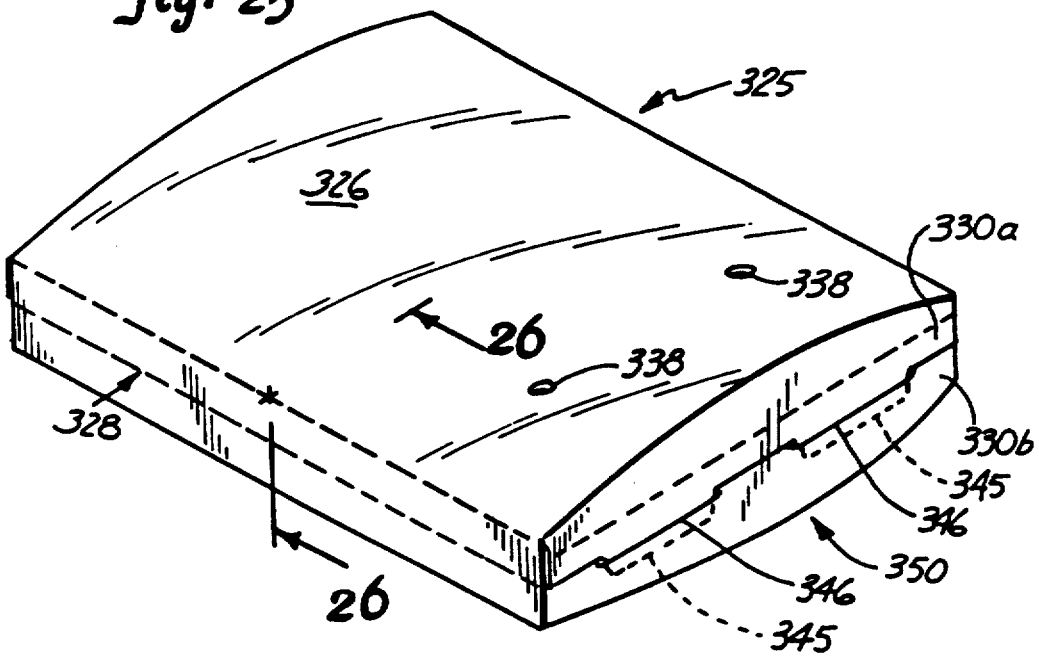
FIG. 25 is a perspective view of the embodiment of the present invention seen in FIG. 23, with the resilient compressible layers therein expanded.
Figure 26:
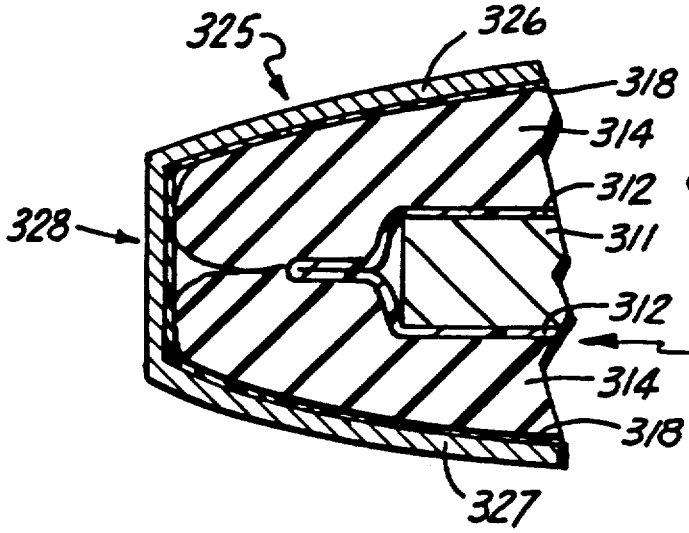
FIG. 26 is a partial sectional view as taken along lines 26—26 in FIG. 25.

In use, an article 311 to be protected is placed within the article pouch 333 of the inner container 310 through its open end 324 (see FIG. 23). A flap 335 having an exposable pressure sensitive adhesive 336 is closed over the open end 324 of the inner container 310, in the same manner as previously discussed for packaging container 10. The outer wall 318 of the inner container 310 is then punctured using a sharp object to breach the hermetic seal about the compressible material 314 and thus allow the compressible material 314 to expand. Preferably, apertures 338 in the major side panels of the outer container 325 provide target areas for puncturing the inner wall 318. FIGS. 25 and 26 illustrate the change in shape (from folded to flattened) of the minor side panel 328, 329 of the outer container 325 as the inner layer of compressible material 314 expand. Additionally, the major side panels 326, 327 bow outwardly upon expansion of the layer of compressible material 314 so that the outer container 324 assumes a somewhat pillow-like shape.

Figure 27:
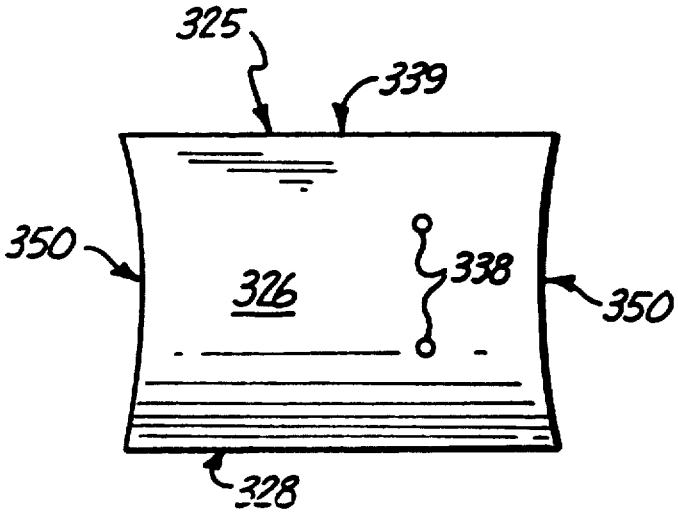
FIG. 27 is a top plan view of the packaging container of the FIG. 25.

After expansion of the compressible material layers 314, the ends of the outer container 325 are closed. End panel 330*a* has one or more tabs 345, which are receivable in opposed slots 346 in end panel 330*b*. The closed outer container 325 has concave inwardly-shaped ends 350 (as illustrated in FIG. 27) to retain the tabs 345 in the slots 346. Once the ends of the outer container 325 are closed and fitted together, as illustrated in FIG. 25, a complete impact-resistent, generally inflexible outer protective wall is defined by the outer container 325 about the inner container 310 and article 311 therein (which is cradled between layers of compressible material 314).

The present invention is further illustrated with a specific example, which details the relative parameters (materials, dimensions, etc.) for a packaging container such as that illustrated in FIGS. 1-6. The container outer wall is defined by a 3 mil blown co-extrusion film of high density polyethylene (HDPE), nylon and low density polyethylene (LDPE) with the nylon layer serving as the air barrier. The LDPE layer (inner layer) is provided for strong, easy to manufacture heat seals, and the HDPE layer is provided with a textured surface for grasping the expanded finished packaging container more easily. This multilayer film is translucent to allow graphics to be read therethrough, has a required air barrier lower than normal polyethylene films, and is supplied by Star-Tex Corporation of Lakeville, Minn. under the trademark "StarPac II."

The inner wall is a 2 mil blown co-extrusion film of ethylene vinyl acetate (EVA), nylon and EVA layers. The nylon serves as the air barrier while the EVA layers make the film heat sealable on both sides. This film is also manufactured by Star-Tex Corporation and is known by the trademark "StarVac II."

The mass of resilient compressible material is ether based polyurethane, with a density of 1.45 pcf and an indentation load deflection (ILD) of 45 pounds. This foam material is available from E.R. Carpenter, Inc. of High Point, N.C., designated as foam stock number S45S. The panel members are made of 50 mil plain chipboard of recycled paper.

To form a packaging container from these components, the outer film was thermal impulse sealed into a bag measuring 12¼ inches by 14⅜ inches (inner dimensions) with an additional 3 inches extension on one of the major sides to serve as a closure flap. An inner bag (pouch) was formed from the inner film, with its inner dimensions being 9½ inches by 12 inches. The inner bag was then placed between two blocks of the polyurethane foam, each of which has expanded dimensions of 1½ inches by 10 ½ inches by 12½ inches. Two panels of chipboard, each measuring 10¾ inches by 12¾ inches were placed on the foam layers, and then a sheet of 20 pound white bond paper was placed on each panel. This combination of paper/panel/foam/inner bag/foam/-panel/paper was then placed in the outer bag for compression, heat sealing (adjacent the open end of the bag to completely define the hermetic chamber between the inner and outer walls) and storing in an uninflated state for later use.

The utility of the packaging container of the present invention is measured by its ability to protect an article placed therein. A variety of parameters come into play in optimizing the performance of the packaging container of the present invention in this regard. For example, varying the thickness of the panel, the size or number of holes into the compressible material chamber and the tightness of the outer wall around the compressible material after expansion are all factors which bear the packaging container's protection of an article therein. These factors can be evaluated by drop performance testing, where the packaging container is dropped and the G-forces on an article therein measured at impact.

Such testing has revealed that increasing the thickness of the protective panel member improves protection of the article when the packaging container is dropped on a major side surface. However, increasing the thickness of the protective panel member decreases article protection if the packaging container is then dropped on its edges or corners. Again, protection is measured by the amount of G-force transmitted to the article in the packaging container. The less G-force the article is subjected to, the more protection it receives from shock and impact forces on the container.

Larger apertures or additional apertures in the packaging container outer wall also provide more protection for an article therein (lesser G-forces). Additional or larger holes allow more air to be expelled from the compressed material chamber, which allows the compressed material to be more absorbent to shock or impact forces. In designing a packaging container for a particular application, the size and location of apertures can be optimized to achieve a particular protection performance criteria, but this relation must also be balanced with the desired initial expansion performance of the compressible material of the packaging container (i.e., many holes may provide better protection against G-forces but result in a more rapid expansion than desired).

As mentioned above, the tightness or tautness of the outer wall about the packaging material also affects article protection performance. When the outer wall is very tight, flat drop performance decreases (higher G-forces are passed on to the article in the packaging container), presumably because the resilient compressible material is precompressed and is not allowed to become as impact-absorbent as it could be. Thus, loosening the tautness of the outer wall about the packaging container achieves a better flat drop performance (less G-forces transmitted to the article therein), but this must be balanced by the possibility that the article may more easily slide or move within the packaging container because the resilient compressible material is not pressed as tightly about the article.

Obviously, the factors of panel thickness, number and size of apertures and tightness of outer wall about the packaging container can be varied to achieve maximum performance and protection criteria for the packaging container. These factors and others (such as material layer thickness) can be modified to develop packaging containers having different protection characteristics as desired.

The packaging container of the present invention provides, in all embodiments, an impact-absorbing container for an article contained therein by means of an expandable resilient mass of material. Variations upon this basic structure include the addition of relatively inflexible wall members to further protect the article from impact and shock forces, variations in the shape of the expandable material mass to that end, specialized walls for protecting the article from potentially damaging electrostatic charges or radiation, and alternative means and structures for facilitating the rupture of the evacuated chamber holding the expandable material mass in a compressed state. As can be readily appreciated, many of these features are combinable to achieve variations of the packaging container of the present invention, as required for particular handling of an article during shipment or storage within such a packaging container.

Although the present invention has been described with reference to preferred embodiments, workers skilled in the art will recognize that changes may be made in form and detail without departing from the spirit and scope of the invention.

What is claimed is:

1. A packaging container for encasing an article which has at least one open end and an article receiving space for reception of the article therein, the packaging container including a wall structure, the wall structure comprising:

an air-impermeable inner wall which is conformable for engaging the article;

an air-impermeable outer wall spaced from the inner wall and bonded thereto to define a hermetic chamber therebetween;

impact-resistant means for protecting the article when within the article receiving space, the protecting means comprising a panel member which is less flexible than the inner wall and positioned adjacent to the outer wall and covering at least a portion of the article receiving space; and a mass of resilient compressible material within the chamber, the resilient material having a first compressed state when a reduced atmospheric pressure is maintained in the chamber and having a second expanded state when the material is exposed to atmospheric pressure, with the resilient material in its expanded state urging the inner wall about the article and providing an impact-absorbing cushion about the article.

2. The packaging container of claim 1 wherein at least two opposed sides of the container include the protective panel member of the wall structure.

3. The packaging container of claim 2 wherein each protective panel member has two side edges and two end edges, and wherein a side panel is hingedly connected along an inner edge thereof to each side edge of the protective panel member.

4. The packaging container of claim 3 wherein upon expansion of the resilient material, outer edges of opposed side panels are spaced apart.

5. The packaging container of claim 3 wherein upon expansion of resilient material, outer portions of opposed side panels are in an overlapped arrangement.

6. The packaging container of claim 3 wherein the container has a closed end opposite its open end, and wherein an end panel is hingedly connected to each protective panel member along the end edge thereof adjacent the closed end of the container.

7. The packaging container of claim 2 wherein the container has a closed end opposite its open end, each protective panel member has two side edges and two end edges, and the end edges of the protective panel members adjacent the closed end of the container are connected.

8. The packaging container of claim 7 wherein an end panel member is hingedly connected between the end edges of the protective panel members.

9. The packaging container of claim 8 wherein the protective panel members and end panel member are formed from a single panel, scored to define the connecting end edges between the protective panel members and the end panel member.

10. The packaging container of claim 8 wherein the end panel member is defined by a first end panel hingedly connected to the end edge of one of the protective panel members and a second end panel hingedly connected to the end edge of the other protective panel member, with the first and second end panels being hingedly connected together intermediately between the opposed protective panel members.

11. The packaging container of claim 1 wherein the mass of resilient material, in its compressed state, is reduced to approximately twenty percent of its original thickness, and upon exposure to atmospheric pressure, expands to eighty percent of its original thickness within one minute.

12. The packaging container of claim 2 wherein the container has a closed end opposite its open end, and wherein the mass of resilient material extends as a layer unitarily along two opposed sides of the container and around its closed end in a U-shaped configuration.

13. The packaging container of claim 2 wherein the container has a closed end opposite its open end, and wherein the mass of resilient material is a unitary mass having an article reception chamber formed therein and having an opening into that chamber which is aligned with the open end of the container.

14. The packaging container of claim 2 wherein the mass of resilient material is defined, in lateral cross-section across the container, as a tubular unitary structure with the ends of the tubular structure aligned with the ends of the container.

15. The packaging container of claim 2 wherein the mass of resilient material has an inner surface adjacent the inner wall and which is preformed to mate with the shape of the article upon expansion of the resilient material.

16. The packaging container of claim 1 wherein the protective panel member is in the chamber.

17. The packaging container of claim 16 wherein the protective panel member has an aperture therethrough to facilitate passage of air into the chamber.

18. The packaging container of claim 16 wherein the outer wall is translucent.

19. The packaging container of claim 18 wherein an indicia-bearing surface is aligned under the outer wall so that the indicia thereon is visible through the outer wall.

20. The packaging container of claim 19 wherein the indicia-bearing surface is on the protective panel member.

21. The packaging container of claim 20 wherein the indica on the protective panel member provides a target area for puncturing through the outer wall and thereby breaching the reduced atmospheric pressure in the chamber.

22. The packaging container of claim 21 wherein the target area of the protective panel member has an aperture therethrough to facilitate passage of air into the chamber.

23. The packaging container of claim 19 wherein the indicia-bearing surface is on a sheet positioned between the outer wall and the protective panel member.

24. The packaging container of claim 23 wherein the indica on the sheet provides a target area for puncturing through the outer wall and thereby breaching the reduced atmospheric pressure in the chamber.

25. The packaging container of claim 1 wherein the outer wall has an aperture therethrough to permit passage of air into the chamber, and further comprising:

resealable means for covering the aperture to control the passage of air therethrough.

26. The packaging container of claim 25 wherein the resealable means comprises:

a tab adherable over the aperture by a pressure sensitive adhesive.

27. The packaging container of claim 1, and further comprising:

means for exposing the chamber to atmospheric pressure.

28. The packaging container of claim 27 wherein the means for exposing comprises a tear strip on one of the walls of the chamber.

29. The packaging container of claim 1 wherein the outer wall defines an envelope adapted for reception therein of the protective panel member, mass of resilient material and inner wall.

30. The packaging container of claim 1 wherein the outer wall and mass of resilient material are between the protective panel member and inner wall.

31. The packaging container of claim 30 wherein the outer wall defines an envelope adapted for reception therein of the mass of resilient material and the inner wall, and further comprising:

an outer container defined by an interconnected plurality of the protective panel members surrounding the envelope, with the outer container having a first generally flattened state when the resilient material in the envelope is compressed and being urged into a second generally box-like state when the resilient material in the envelope is expanded.

32. The packaging container of claim 31 wherein the envelope and outer container have aligned open ends which are selectively closable.

33. The packaging container of claim 32 wherein each closable end of the outer container is defined by a plurality of interlocking protective panel members.

34. The packaging container of claim 31 wherein the outer container has at least two major sides defined by opposed protective panel members.

35. The packaging container of claim 34 wherein upon expansion of the resilient material in the envelope, each major side of the outer container is bowed outwardly.

36. The packaging container of claim 31 wherein the protective panel members of the outer container are formed from a single panel, scored to define connecting edges between adjacent protective panel members.

37. The packaging container of claim 36 wherein upon expansion of the resilient material in the envelope and closure of an end of the outer container, the interlocking protective panel members defining that end are bowed inwardly.

38. The packaging container of claim 37 wherein the outer container has at least two minor sides defined by opposed protective panel members, with each protective panel member defining a minor side of the outer container being scored longitudinally and intermediately to facilitate placing the outer container in its first generally flattened state.

39. A packaging container for encasing an article which comprises:

an air-impermeable inner wall which defines an article chamber that is conformable for engaging the article and that has an open end for reception of the article therein;

an air-impermeable outer envelope wall spaced from the inner wall and bonded thereto to define a hermetic chamber therebetween, with the outer envelope wall having an opening therein aligned with the open end of the chamber;

a mass of resilient compressible material positioned within the hermetic chamber between the outer envelope wall and the inner wall, with the resilient material having an open portion aligned with the open end of the article chamber and opening of the outer envelope wall, and with the resilient material having a first compressed state when flattened under reduced atmospheric pressure in the hermetic chamber and having a second expanded state when exposed to atmospheric pressure whereby, upon expansion, the resilient material provides an impact-absorbing cushion about the article in the article chamber; and wherein the opening of the outer envelope wall is smaller than the open end of the article chamber.

40. The packaging container of claim 39 wherein the outer envelope wall is defined by opposed sheet portions each having two side edges and two end edges, wherein the sheet portions are bonded together along peripheral sections of their side edges and wherein portions of the sheet portions adjacent the opening thereof are bonded together adjacent their side edges.

41. The packaging container of claim 39 wherein the outer envelope wall is translucent.

42. The packaging container of claim 41 wherein an indica-bearing sheet is aligned between the outer envelope wall and the mass of resilient compressible material so that the indicia thereon is visible through the outer wall.

43. The packaging container of claim 42 wherein the indicia on the sheet provides a target area for puncturing through the outer envelope wall and thereby breaching the reduced atmospheric pressure in the hermetic chamber.

44. A packaging container for protective containment of an article therein, comprising:

an outer wall which is flexible and air-impermeable, with the outer wall defining an envelope having two major opposed sides and a sealable open end for reception of the article therein;

an inner wall within the envelope, the inner wall being flexible, air-impermeable, and adapted to define a pouch for reception of the article which is bonded to the envelope at least adjacent the open end thereof to define a hermetic chamber between the inner and outer walls;

a relatively inflexible and generally rectangular protective panel member within the chamber on each major side of the envelope; and a mass of resilient compressible material within the chamber at least between the inner wall and each protective panel member, the resilient material having a first compressed state when a reduced atmospheric pressure is maintained in the chamber and having a second expanded state when the material is exposed to atmospheric pressure, with the resilient material in its expanded state urging the inner wall about the article, providing an impact-absorbing cushion about the article and urging each protective panel member outwardly against the outer wall to provide an impact-resistant shield about the article.

45. A packaging container for protective containment of an article therein, comprising:

an outer wall which is flexible, air-impermeable and translucent, with the outer wall defining an envelope having two major opposed sides and a sealable open end for reception of the article therein;

an inner wall within the envelope, the inner wall being flexible, air-impermeable, and adapted to define a pouch for reception of the article which is bonded to the envelope at least adjacent the open end thereof to define a hermetic chamber between the inner and outer walls;

an indicia-bearing sheet aligned within the chamber so that the indicia thereon is visible through the translucent outer wall of the envelope; and a mass of resilient compressible material within the chamber at least between the inner wall and the indicia-bearing sheet, the resilient material having a first compressed state when a reduced atmospheric pressure is maintained in the chamber and having a second expanded state when the material is exposed to atmospheric pressure, with the resilient material in its expanded state urging the inner wall about the article and providing an impact-absorbing cushion about the article.

46. The packaging container of claim 45 wherein the indicia on the sheet provides a target area for puncturing through the outer wall of the envelope to breach the reduced atmospheric pressure in the hermetic chamber.

* * * * *

UNITED STATES PATENT AND TRADEMARK OFFICE

CERTIFICATE OF CORRECTION

PATENT NO. : 5,129,519

DATED : July 14, 1992

INVENTOR(S) : David et al.

It is certified that error appears in the above-identified patent and that said Letters Patent is hereby corrected as shown below:

Col. 8, line 65, Insert --for-- after "advantageous"

Col. 8, line 67, Insert --of the panels relative to the layers of compressible-- after "skewing"

Col. 14, line 59, Insert --upon-- after "bear"

Signed and Sealed this

Twenty-first Day of June, 1994

*Attest:*

Bruce Lehman

BRUCE LEHMAN

*Attesting Officer*

*Commissioner of Patents and Trademarks*